US006154988A

United States Patent [19]

Bykov et al.

[11] Patent Number: 6,154,988

[45] Date of Patent: Dec. 5, 2000

[54] MACHINE FOR DIGGING UNDER PIPES AND CATERPILLAR TRACTION DEVICE

[75] Inventors: Alexandr V. Bykov, Kiev; Stanislav K Vasilenko, Kremenchug, both of Ukraine; Alexandr S. Dzhardzhimanov; Marat Sh. Ibragimov, both of Moscow, Russian Federation; Andrei B. Koval, Kiev, Ukraine; Alexandr S. Kumylganov, Moscow, Russian Federation; Jury B. Leichenko, Kiev, Ukraine; Vladimir D. Musiiko, Kiev, Ukraine; Vasily I. Savenok, Kiev, Ukraine; Valery D. Chernaev, Moscow, Russian Federation; Viktor I Yakovlev, Krementschug, Ukraine

[73] Assignees: Obschestvo s orgranichennoi otvetstvennoshtju Nauchno issledovatelsky i tekhnickesky tsentr "Rotor", Kiev, Ukraine; Aktsionernoe obschestvo otkrytogo tipa Aktsionernaya kompania po transportunefti "Transeft ", Moscow, Russian Federation; National Stock Company, Kremenchuk, Ukraine

[21] Appl. No.: 09/147,939

[22] PCT Filed: Sep. 25, 1997

[86] PCT No.: PCT/UA97/00012

§ 371 Date: Jun. 3, 1999

§ 102(e) Date: Jun. 3, 1999

[87] PCT Pub. No.: WO98/15165

PCT Pub. Date: Apr. 16, 1998

[30] Foreign Application Priority Data

Sep. 25, 1996 [UA] Ukraine ..... 96093693

[51] Int. Cl.[7] ..... E02F 5/04; E02F 5/10; B62D 55/08

[52] U.S. Cl. ..... 37/352; 405/154; 305/60; 305/191

[58] Field of Search ..... 37/142.5, 249, 37/250, 385, 386, 352, 365; 405/159, 160, 161, 162, 163, 164, 154; 305/160, 191, 198, 60

[56] References Cited

U.S. PATENT DOCUMENTS

| | | | |
|---|---|---|---|
| 3,429,132 | 2/1969 | Martin | 405/161 |
| 3,877,237 | 4/1975 | Norman | 61/72.4 |

(List continued on next page.)

FOREIGN PATENT DOCUMENTS

| | | |
|---|---|---|
| 2605373 | 8/1976 | Germany . |
| 119836 | 9/1959 | Russian Federation . |

(List continued on next page.)

*Primary Examiner*—Thomas B. Will
*Assistant Examiner*—Nathan Mammen
*Attorney, Agent, or Firm*—Burns, Doane, Swecker & Mathis, L.L.P.

[57] ABSTRACT

The present invention is for a machine for digging under pipes, wherein the machine comprises a frame having a caterpillar drive traction device mounted thereon, as well as left and right end effectors. The end effectors are each made in the shape of a mount which is attached to the frame and capable of forced rotation about the vertical axis. These end effectors also comprise a cylindrical endless-screw-type driving cutters as well as a cylindrical blade attached to the mount coaxially behind the cutter. The cutter is mounted at a lower end and on the side of the mount so that its rotation axis is horizontal. The machine further includes a transversal stabilization device comprising two stabilization mechanisms, wherein each mechanism comprises an adjustable-height support member that rests on the bottom of the trench. The traction device includes a frame as well as a caterpillar that comprises rigid brackets and flexible support members. The brackets extend outwardly from the external surface of the caterpillar central part. The flexible support members are connected to the brackets so as to be incapable of linear displacement and are made short enough so as to stretch about the profile of the pipe cross-section.

39 Claims, 8 Drawing Sheets

U.S. PATENT DOCUMENTS

| | | | |
|---|---|---|---|
| 4,395,158 | 7/1983 | Brooks | 405/161 |
| 5,601,383 | 2/1997 | Zanin | 405/161 |
| 5,639,185 | 6/1997 | Saxon | 405/163 |

FOREIGN PATENT DOCUMENTS

| | | | |
|---|---|---|---|
| 524882 | 8/1976 | Russian Federation . | |
| 562625 | 6/1977 | Russian Federation . | |
| 1198166A | 12/1985 | Russian Federation . | |
| 1263765A1 | 10/1986 | Russian Federation . | |
| 1831456A3 | 7/1993 | Russian Federation . | |
| 2003559 | 11/1993 | Russian Federation . | |
| 0779519 | 11/1980 | U.S.S.R. | 37/142.5 |
| 2058174 | 4/1981 | United Kingdom | 405/159 |

Fig. 3
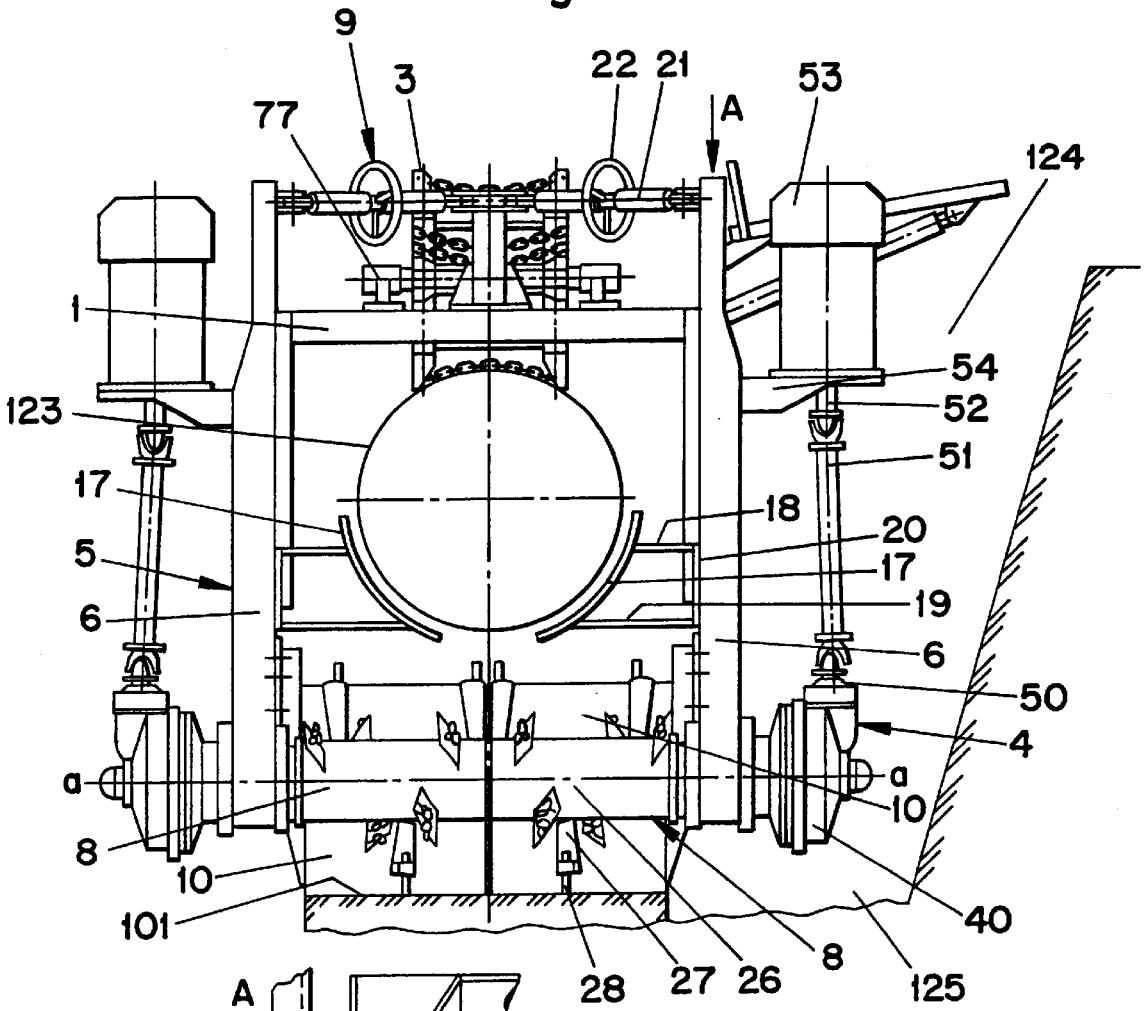
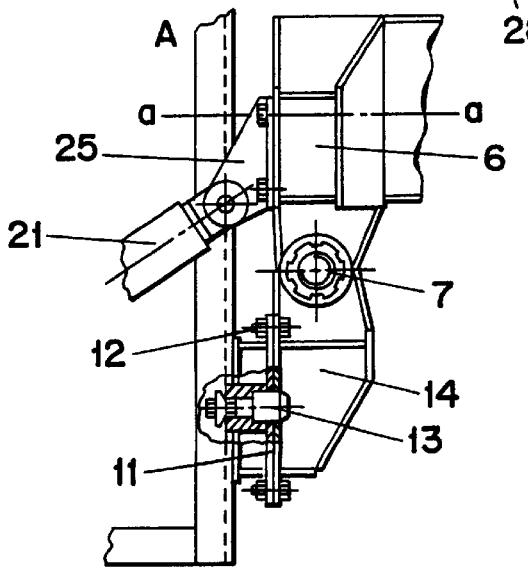
Fig. 4

Fig. 5
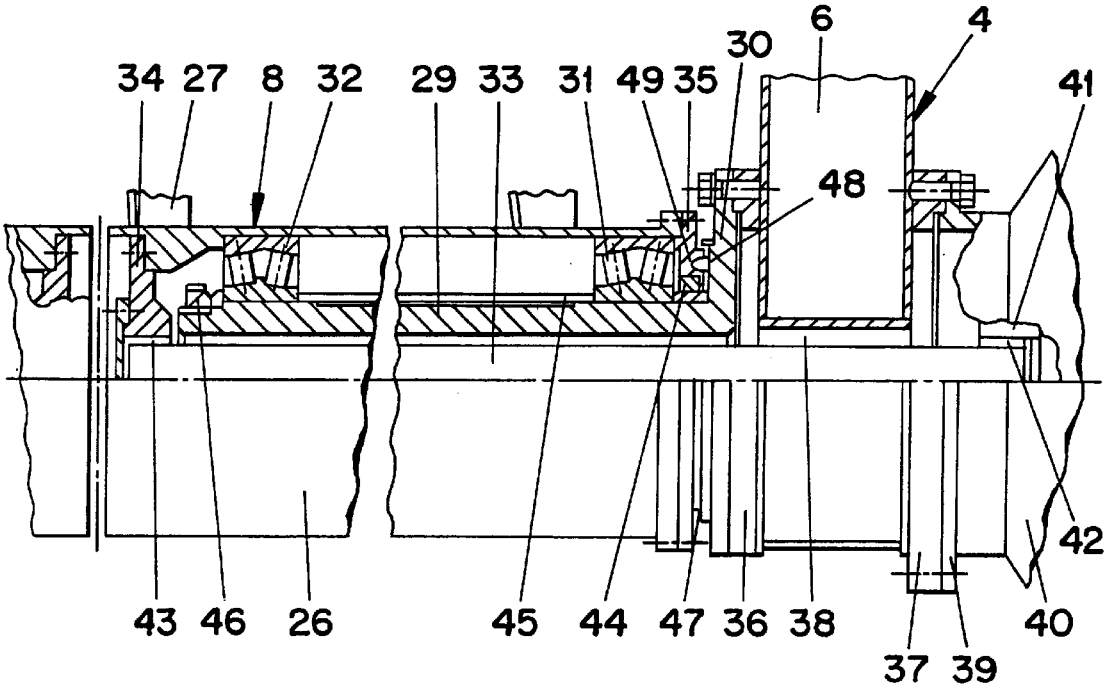
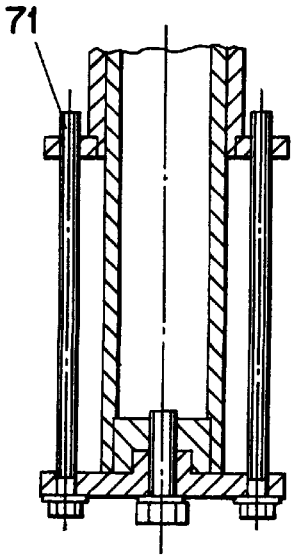
Fig. 11
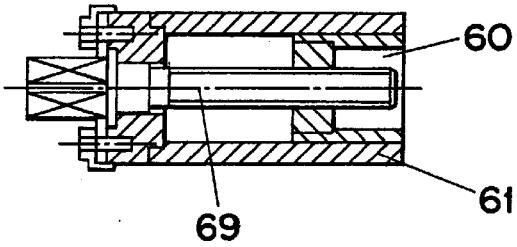
Fig. 8

Fig. 12
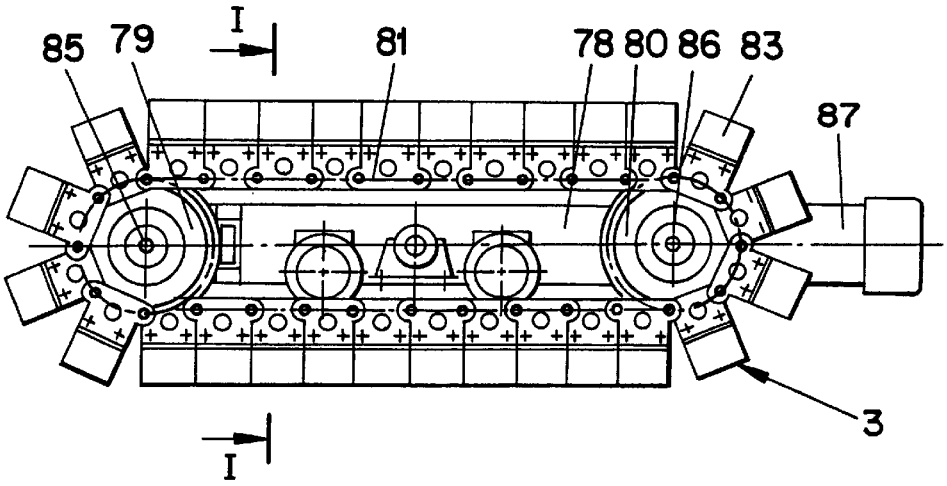
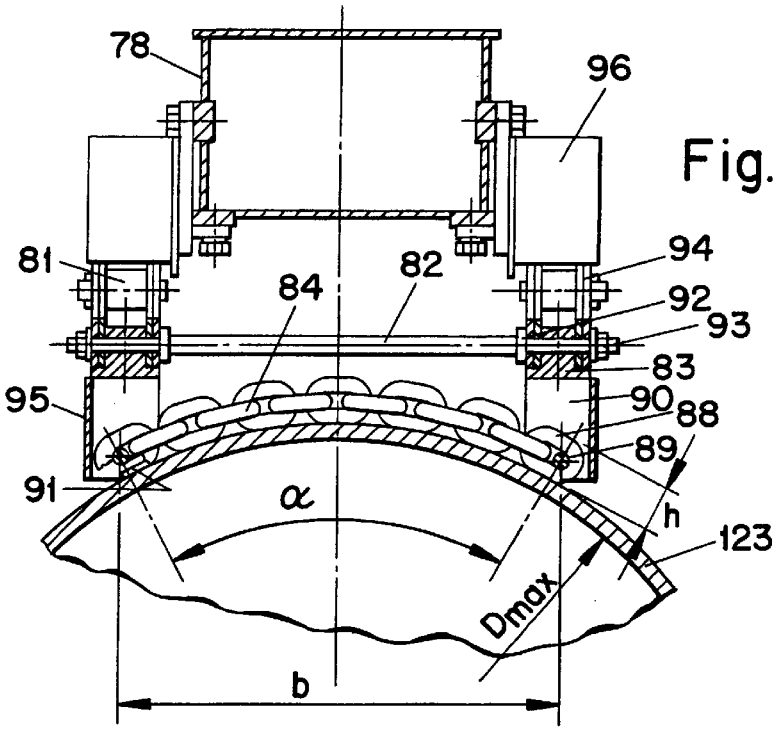
Fig. 13
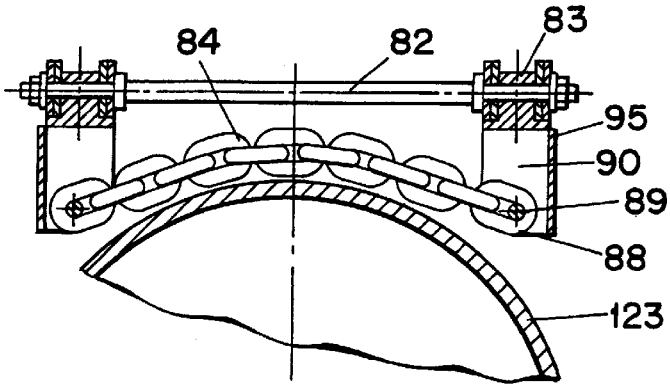
Fig. 14

MACHINE FOR DIGGING UNDER PIPES AND CATERPILLAR TRACTION DEVICE

TECHNICAL FIELD

The invention relates to build machines for overhauling, more specifically replacement of the insulating coating of the main oil and gas pipelines or pipelines for other applications, namely to machines for digging under pipelines of a broad range, mostly of large diameters for the height sufficient for the pipeline repair in the trench, without its lifting. The invention also relates to the caterpillar travelling units preferably for movement over pipelines or other extended bodies of a round, elliptical, oval, or other convexo-curvilinear cross-sectional shape.

BACKGROUND ART

Known is a machine for digging under pipelines, containing symmetrically located end effectors made in the form of rotary posts with the driven spiral mills with the right-hand direction of blade turn for the mill located on the left side in the direction of the machine movement and left-hand direction for the right mill, and the breast located behind the spiral mills (USSR Auth. Cert. #1263765, cl. E02F 5/06, 1986). However, in view of the fact that the breast is made common for both end effectors and fastened on their posts, the self-digging of the machine under the pipeline is impossible. As the posts rotate around the horizontal longitudinal axes with the spiral mills moved out from under the pipeline, the posts do not fall within the trench clearance limits, thus requiring digging of the latter using additional mechanisms or manually. Besides, with the mentioned direction of the blade turns the mills rotation proceeds in such a way, that the upper blades are moving in the direction opposite to that of the machine movement, which results in the soil throwing over the breast with the increase of the mills rotation speed.

Known is a machine for pipeline digging, incorporating posts with the driven spiral mills mounted on telescopic shafts (USSR Auth. Cert. # 1198166, cl. E02F 5/02, 1985). However, the design of the telescopic shaft, of the drive for its extension and assembly of its mounting on the post, is complex, unreliable, not capable of standing high loads and with a large diameter of the pipeline, cannot practically fall within clearance limits of the post. Besides, the absence of breasts lowers the effectiveness and performance of the spiral mills.

Known is a machine for digging under the pipeline which incorporates the frame, symmetrically located end effectors made in the form of posts placed on both sides of the pipeline and mounted on a frame with the capability of forced rotation around the horizontal longitudinal axes, and driven rotors mounted on the lower ends of the posts by means of vertical shafts located on both sides of the pipeline, and mounted on the frame travelling unit of the stepping type (USSR Auth. Cert. # 24882, cl. E02F 5/08, 1976). In view of the large dimensions of the rotors and of the posts rotation around the horizontal longitudinal axes with the rotors moved out from under the pipeline, they do not fall within clearance limits of the trench, thus, firstly not permitting the machine to be moved over the pipeline with the rotors brought apart, for instance for by-passing an insurmountable obstacle, and secondly, requiring digging up the trench for the machine mounting-dismantling. In order to prevent the rotors jamming under the pipeline, the axes of the posts rotation should be maximum close to the vertical plane of the pipeline symmetry, thus not permitting the travelling unit to be placed between them, thereby increasing the machine overall dimensions. The absence of the breasts adversely affects the quality of the trench bottom under the pipeline. The upper end faces of the rotors coming closer to the pipeline lower surface for its cleaning from the soil, increases the probability of the pipeline damaging. Besides, the stepping travelling unit has comparatively large overall dimensions, complex design and is complicated to operate. Here, the average speed of the machine movement is more than 2 times lower than the speed of rotors feed to the soil face, thus lowering the machine efficiency and increasing the power consumption, as a result of idle running of the rotors during the machine stoppage.

The closest to the claimed machine is the machine incorporating a frame, with the end effector made in the form of a post located to the side of the pipeline and mounted on a frame with the capability of forced rotation around the vertical axis, the driven part mounted on the post lower end and placed to the side of the latter with the horizontal location of its longitudinal axis, the breast located in the direction of the machine movement behind the driven part, and the cutter made in the form of a ring segment and located in front of the breast, as well as the travelling unit and idle wheels mounted on the frame for the machine movement over the pipeline. Unlike the claimed machine, in the known machine the vertical axis of the post rotation is located in one plane with the longitudinal axis of the driven part, which is made in the form of a chain bar, the breast and cutter are fastened to the frame, while the drive travelling unit is made in the form of bull-wheels mounted at an angle to each other (USSR Auth. Cert. # 562625, cl. E02F 5/10, 1977). In the known machine, as a result of the driven part being made in the form of a chain bar which just undercuts the soil mass, without loosening it, a high traction force is required in order to remove the soil from under the pipeline. Here, the travelling unit cannot provide the sufficiently high traction force, as it is impossible to press the wheels to the pipeline surface with a large force because of a small area of contact of the wheels with the pipeline. For the same reason, it is impossible to increase the machine weight. This results in the known machine having a low efficiency, providing digging under pipelines of a small diameter and to a small height. As the breast and the cutter are fastened to the frame, self-digging is impossible, and mounting-dismantling of the breast and the cutter are required during the machine mounting and taking off. Besides, in rotation of the post to move the chain bar from under the pipeline, the machine center of mass is shifted towards the post, this impairing the steadiness of its position on the pipeline. The removal of the soil for under the pipeline to one side, requires increasing the depth of the pit which is not rational in technical terms. The known machine requires changing the wheels of the drive travelling unit for its mounting on pipelines of different diameters, thus making its operation more difficult.

The closest to the claimed device, is the known caterpillar travelling unit incorporating a frame and a caterpillar chain which includes the plate traction chains mounted on the frame on the tension and drive sprockets, rigid elements protruding beyond the contour of the caterpillar chain middle part, and flexible supporting elements coupled with the rigid elements. Unlike the claimed unit, in the known device the rigid elements are made in the form of outer plates of the traction chains, whereas the flexible supporting elements are coupled with the rigid elements by extended slots with the capability of displacement within the length of the slots in order to eliminate the tension of the flexible supporting elements. Here, the caterpillar chain includes the rubber element mounted on the traction chains for accommodating the support-traction loads (USSR Patent # 1831456, cl. B26D 55/24, 1993, FIG. 7). In the known device the flexible supporting elements do not accommodate the support-traction loads because of elimination of their tension, but serve as anti-skidding elements for the rubber element. The presence of the rubber element, first of all, lowers the reliability and fatigue life of the device, especially when the travelling unit is used on the pipelines with bitumen insulation because of the bitumen mastic sticking to the surface of the rubber element and impossibility of cleaning it, and secondly, increases the resistance to the displacement of the travelling unit through losses for the rubber element deformation. Thirdly, it makes the device design more complicated.

The advantages of replacement of the insulating coating of the operating pipelines performed on the design elevations of the pipelines in the trench mostly without interruption of the operation of the latter, have long ago become obvious for the experts who began taking certain efforts for its practical implementation. However, one of the reasons for which such a technology has not yet found due acceptance in practice, is the fact that the construction machinery used in practice, as well as the technical means which are not used in practice, but are known from the state-of-the-art publications, do not offer a satisfactory solution for the problem of digging under pipelines. The most preferable approach is performance of work to replace the pipeline insulating coating during the continuous displacement of the entire system of the appropriate technical means, without the use of fixed supports for allowing the pipeline to rest on the trench bottom. Here, higher requirements are made of the technical means for digging under pipelines, which are met by the above technical means to an even smaller degree. In this case, the device for digging under the pipeline should be capable of fulfilling its function during its continuous displacement with the speed which is equal to the speed of displacement of the entire system (preferably 150 to 100 m/h); here the above means should make the minimum impact on the pipeline, eliminating its damage. In addition, the means for digging under the pipeline should have minimal overall dimensions in the direction along the pipeline, in order to reduce the length of the unsupported section of the pipeline to such an extent as to avoid or minimise the use of the mobile means for the pipeline support. Here, the above means should provide a rather considerable height of digging (about 0.8 m) with a broad range of preferably large diameters of the pipelines, so as to enable the operation of the means of the pipeline cleaning and insulation. It is exactly the absence currently of such means of digging under pipelines which largely prevents a wide practical introduction of the technology of replacement of the insulating coating of the operating pipelines in the trench without the use of supports for allowing the pipeline to rest on the trench bottom. Thus, the inventors faced a challenge still unsolved in a manner suitable for practical application, despite the numerous attempts at solving it over many years.

SUMMARY OF THE INVENTION

The invention is based on the task of providing, in the machine for digging under the pipeline, the improvement of the machine efficiency, increase of the uncovered pipeline diameter and category of the worked soil with the simultaneous provision of the capabilities of self-digging of the end effectors under the pipeline, machine mounting on the pipeline and removal from it without the need to mount-dismantle the structural elements, machine displacement to by-pass an insurmountable obstacle and along the curvilinear sections of the pipeline, digging under pipelines of various diameters, by upgrading the end effectors to reduce their resistance to the machine displacement, as well as by upgrading the drive travelling unit to increase its traction force and reduce the specific pressure on the pipeline.

The above task is solved by that in the machine for digging under pipelines, including the mounted on the frame, drive travelling unit for the machine displacement along the pipeline, and, at least one end effector incorporating the post mounted on the frame with the capability of forced rotation around the vertical axis, the driven part for working the soil under the pipeline, mounted on the post lower part and located to the side of the latter, and the breast located behind the driven part in the direction of the machine displacement, according to the invention, the driven part of the end effector is made in the form of a spiral mill, and the breast is mounted on the post, while its working surface facing the spiral mill, is made concave.

The reduction of the resistance to the machine displacement is provided by using the spiral mills with breasts. The rotation of posts with the spiral mills, breasts and cutters around the vertical axes, enables the self-digging of the end effectors under the pipeline and their falling within clearance limits of the trench when they are moved out from under the pipeline, this allowing the machine displacement along the pipeline to by-pass and dig around the insurmountable obstacles. Here, a stable position of the machine center of mass by height is preserved, as well as the quality of the trench bottom under the pipeline. Mounting of the breasts and cutters on the posts eliminates the need for their mounting-dismantling during the machine mounting—taking off. Reduction of the resistance to the machine displacement allows increase of the speed of the machine movement, and, therefore, of its efficiency, working heavy soils with a large area of the face, this being required for digging under large-diameter pipelines to a great height necessary for its repair without lifting it.

In the actual forms of embodiment of the invention and/or under special conditions of its use, the spiral mill and the breast working surface are made to have a cylindrical shape, here the axis of the spiral mill rotation is located horizontal and co-axial with the axis of the breast working surface. This configuration of the machine is the simplest in design and yields the highest technical result.

In addition, the end effector is fitted with a cutter which is made in the form of a segment of a ring, is located in front of the breast and fastened to the post,. The cutter provides the cleaning of the pipeline lower part from the stuck soil and is required when the machine is used on the cohesive sticky soils.

In addition, the post of the end effector is mounted on the frame with the capability of placement at least into two positions by height. This allows the machine to be adjusted for digging under pipelines of different diameter.

Additionally, the machine incorporates two end effectors made as the mirror reflection of each other and located symmetrical relative to the machine longitudinal axis. Such an embodiment of the machine is preferable, as in this case the distance of the soil displacement by the spiral mills and the depth of the pits for accommodating the soil removed from under the pipeline, are reduced, and at rotation of the end effectors a stable position of the center of the machine mass in the transverse direction is also preserved.

In addition, the above vertical axes of rotation of the posts relative to the axes of rotation of the spiral mills, are shifted in the direction opposite to the breasts. This provides for bringing the end faces of the spiral mills of the right and left end effectors into close contact, and, therefore, working the soil with the spiral mills across the entire width of the face.

Furthermore, the spiral mills are made with the left-hand direction of the blade turn for the spiral mill located on the left in the direction of the machine movement, and with the right-hand direction for the spiral mill located on the right. The appropriate direction of the turns of the mill blades eliminates the soil throwing over the breast, here the speed of the mills rotation can be increased, thereby reducing the thickness of the cut strip of the soil, and, therefore, the force of cutting and resistance to machine displacement In addition, the drive travelling unit is made as a caterpillar device, whose the caterpillar chain is located in the vertical plane.

Additionally, the machine is fitted with idle wheels, levers mounted on the frame rear part with the capability of forced rotation and fixation, and telescopic supports whose the inner elements are mounted to allow a forced displacement and fixation in the outer elements which are fitted with brackets mounted on the levers with the capability of forced displacement and fixation, here the former of the mentioned wheels are made conical and are fastened on the ends of the inner elements of the telescopic supports with their location under the pipeline in the vertical planes parallel to the pipeline longitudinal axis, while the second are located in the horizontal plane, and their axles are mounted on the lower horizontal plates of the frame, with the capability of their placement at least, into two positions across the machine width. The large support surface of the caterpillar traveling unit and the higher coefficient of engagement with the pipeline surface provide an increase of the traction force and reduction of the specific pressure on the pipeline, thus enhancing the technical result derived at the expense of reduction of resistance to machine displacement. The capability of mounting the caterpillar travelling unit with the chain in the vertical plane on pipelines of various diameter without any readjustment simultaneously with the capability of mounting the posts in several positions by the frame height, enables digging under pipelines of a broad range of diameters. The wheels, which are relieved from the support-traction loads due to the caterpillar travelling unit, provide the direction of the machine movement at relatively low specific pressures on the pipeline and the increase of the machine stability in the longitudinal direction. Mounting of the conical wheels on rotary levers with telescopic supports provides their adjustment for pipelines of different diameters and their removal from under the pipeline without dismantling, when the machine is taken off the pipeline or moves around an insurmountable obstacle.

In addition, the machine is fitted with the device for transverse stabilization of the machine. The availability of the above device guarantees elimination of the machine skewing in the transverse plane.

Furthermore, the device for the machine transverse stabilization incorporates at least one stabilising mechanism including a supporting element for resting against the trench bottom, which is mounted on the rear part of the breast with the capability of forced rotation or linear displacement in the vertical direction. In addition, the supporting element is made in the form of a ski which is connected to the breast by the first hinge, and by the second hinge it is connected to the bearing element of a variable length, which is connected to the breast by the third hinge. Additionally, the bearing element of a variable length is made in the form of a screw jack which by a telescopic propeller shaft is connected to the drive which is mounted on the machine frame. In addition, the drive is made as the manual type drive. Furthermore, the device of the transverse stabilization of the machine incorporates two stabilizing mechanisms made similar to each other and spaced in the transverse direction. Such an embodiment of the device for transverse stabilization is preferable, as it is sufficiently simple in design, and is reliable and simple in service.

The invention is also based on the goal of providing in the caterpillar travelling unit, an improvement of the reliability and fatigue life, lowering of resistance to displacement and simplification of the design of the travelling unit, by upgrading the caterpillar chain for accommodation of the support-traction loads through the flexible supporting elements.

The above goal is achieved by that in the caterpillar travelling unit designed predominantly for displacement over pipelines, incorporating a frame and a caterpillar chain mounted on the frame on the tension and drive sprockets, and including rigid elements protruding beyond the outer surface of the middle part of the caterpillar chain and arranged in two rows which are spaced across the caterpillar chain, and flexible supporting elements connected to the rigid elements, according to the invention, the flexible supporting elements are connected with the rigid elements without the capability of linear displacements and are made short enough to provide the capability of their tension by the contour of the cross-section of the pipeline of the design diameter or the cross-section of a convex-curvilinear shape of any other extended body of the design size; here the caterpillar chain is made rigid enough in the transverse direction for accommodating the forces of tension of the flexible supporting elements. The above distinct features provide the capability of accommodating the support-traction loads through the flexible supporting elements due to their tension, thus allowing elimination from the device design of the rubber element which lowers the reliability and fatigue life and increases the resistance to the unit displacement, as well as making its design more complicated.

In the specific forms of embodiment of the invention and/or under special conditions of its use, the caterpillar chain is made in the form of two plate traction chains mounted on the above-mentioned drive and tension sprockets, and rigid cross-pieces located in the planes normal to the longitudinal axis of the unit, and fastened on the inner and outer plates of the traction chains; here the rigid elements are made in the form of brackets rigidly coupled with the ends of the rigid cross-pieces. In addition, the flexible supporting elements are made in the form of chains whose end links are located in the planes normal to the device longitudinal axis, and are connected by pins with the bracket plates located in parallel to them, which from the pipeline side are made to have bevels, while the rigid cross-pieces are made in the form of axles whose ends are rigidly mounted in the co-axial holes made in the plates of the traction chains and located between them parts of the brackets of the length equal to the pitch of the traction chains. Such a design of the travelling unit for the digging machine is preferable ill terms of the simplicity and reliability of the structure, as well as a higher coefficient of engagement with the pipeline considering the presence of a layer of old insulation and stuck soil on its surface.

BRIEF DESCRIPTION OF THE DRAWINGS

The other parts and features of the invention will become obvious from the given below description of the specific variants of its implementation with references to the accompanying drawings, in which:

FIG. 3 is the same, front view;

FIG. 4 is view A in FIG. 3;

FIG. 5 is section B—B in FIG. 1;

FIG. 8 is section E—E in FIG. 6;

FIG. 11 is view H in FIG. 6;

FIG. 12 is the drive travelling unit, side view,

FIG. 13 is section I—I in FIG. 12, when the drive travelling unit is mounted on the pipeline of the largest design diameter;

FIG. 14 is the same in mounting of the travelling unit on the pipeline of the smallest design diameter;

DESCRIPTION OF EXAMPLES OF EMBODIMENT OF THE INVENTION

Figure 1:
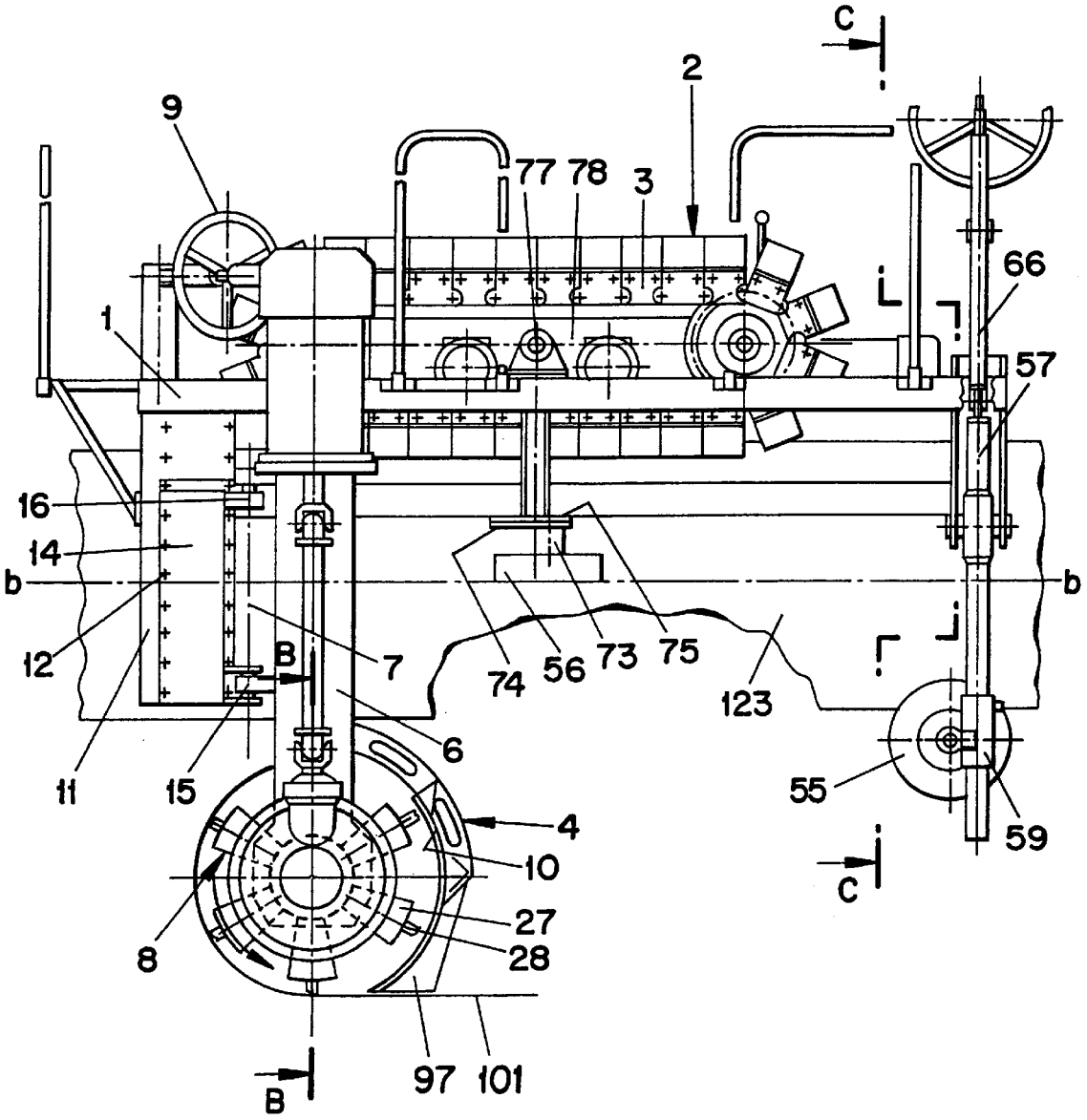
FIG. 1 presents the claimed machine for digging under the pipeline, side view.

The machine for digging under pipelines incorporates frame 1 which carries device 2 for machine displacement over the pipeline with caterpillar drive travelling unit 3, end effectors left 4 and right 5 in the direction of the machine displacement, which have similar design, are a mirror reflection of each other and are located symmetrical relative to the pipeline longitudinal axis.

Each of the end effectors incorporates post 6 which is located to the side of the frame and is mounted on frame 1 with the capability of rotation around vertical axle 7, drive part made in the form of cylindrical spiral mill 8, mechanism 9 for rotation and fixation of post 6 in the working and idle positions and breast 10 whose working surface facing spiral mill 8, is made to have a cylindrical shape. The front side part of frame 1 carries vertical plate 11, on which bracket 14 is mounted by bolts 12 and dowels 13 in one of the several possible positions by height. The latter is connected to post 6 by means of hinges 15, 16 spaced along its height and co-axial with axle 7.

Spiral mill 8 extends as a cantilever in the lower part of post 6 with the predominantly horizontal position of its axis of rotation. Breast 10 is located in the direction of the machine displacement behind spiral mill 8 and is supported as a cantilever by post 6. Here, the axis of the working surface of breast 10 is co-axial with the axis of rotation of mill 8. Vertical axle 7 around which post 6 rotates relative to the axis of rotation of spiral mill 8, is shifted oppositely to breast 10 (ahead in the direction of the machine movement in FIGS. 1 and 2).

The vertical position of axles 7 is of critical importance for obtaining the technical result specified for the invention. Here, spiral mill 8 and working surface of breast 10 in other embodiments of the machine can have a conical or other shape predominantly with a smaller diameter of the end which is removed from post 6, the axis of breast 10 can be located with a certain shift relative to the axis of mill 8 which can be deflected from the horizontal position. This, however, is an unnecessary complication of the machine design. The cylindrical, conical or other spiral mill should be understood to be such a mill which during the soil working creates a face in the form of a cylindrical, conical or other surface, respectively.

In addition, it should be noted that the vertical and horizontal positions of the machine structural members should be understood to mean two positions normal to each other, which when device 2 for machine displacement over the pipeline with a caterpillar drive travelling unit 3 is mounted on a horizontally located pipeline, will coincide with the vertical and horizontal gravitational axes, respectively.

Each of end effectors 4, 5 additionally incorporates cutter 17 which is made in the form of one fourth or a smaller part of a ring, located above spiral mill 8 with the capability of enclosing the lower side surface of the pipeline. Cutter 17 has a bracket made in the form of upper 18 and lower 19 cutters and plate 20 connecting the ends of cutters 18, 19 and fastened on post 6. In order to provide the capability of digging under pipelines of different diameters, plate 20 is fastened to post 6 with the ability of mounting plate 20 in several fixed positions by height. Here, if the diameters of the uncovered pipelines differ significantly, it is preferable for the machine to have one or several additional replaceable cutters 17 made to accommodate different pipeline diameters. Cutter 17 is designed for cleaning the pipeline lower surface from the stuck soil. In the case when the machine is used on sandy or other granular soils with a low ability for sticking to the pipeline, cutter 17 need not be used.

As rotation of post 6 is performed in the horizontal plane, mechanism 9 of post rotation does not take any load from the weight of post 6 and the end effector parts mounted on it. Here, mechanism 9 should preferably be made in the form of turn buckle 21 with steering wheel 22, which is located above working platform 23 of frame 1. Turn buckle 21 is hinged to bracket 24 which is mounted in the front part of frame 1 along its longitudinal axis, and bracket 25 which is fastened on the surface of post 6 facing the frame. Travel of turn buckle 21 is sufficient for rotation of post 6 through not less than 90° for its movement from the working position in which spiral mill 8 is located under the pipeline, and its axis of rotation is normal to pipeline axis, into the idle position in which spiral mill 8 is located to the side of the pipeline, and the axis of its rotation is parallel to the pipeline axis. Here, in the working position the end faces of spiral mills 8 and breasts 10 of left 4 and right 5 end effectors facing each other, are in close contact due to shifting of axle 7 relative to the axis of spiral mill 8 oppositely to breast 10.

Spiral mill 8 of each end effector 4, 5 is made in the form of hollow shaft 26 whose outer surface carries blades 27 with cutters 28; tubular axle 29 with flanges 30 at one of its ends, bearings 31, 32 located inside hollow shaft 26, on which the shaft is installed on tubular axle 29, drive torsion shaft 33 located inside tubular axle 29, first cover 34 which is fastened to the removed from flange 30 first end face of hollow shaft 26, and second cover 35 with a hole for accommodating tubular axle 29 which is fastened to the second end face of hollow shaft 26. Co-axial to each other flanges 36, 37 and through-thickness hole 38 for drive shaft 33, are made on the opposite surfaces of post 6. Flange 30 of tubular axle 29 and flange 39 of the case of reduction gear 40 of spiral mill drive, are bolted to flanges 36, 37, respectively. The ends of drive torsion shaft 33 are coupled with the capability of transfer of the torque. Preferable is the embodiment of the above ties of drive shaft 33 in the form of gear-type couplings 42, 43 which include gear rings made on the outer surface of the ends of the drive torsion shaft 33, and gear rings made on the inner surfaces of cover 34 and output shaft 41. Gear-type couplings 42, 43 with their relatively small dimensions, ensure the transfer of a high torque and compensation for the relative skewing of the drive torsion shaft 33 with cover 34 and output shaft 41. The inner rings of bearings 31, 32 are fixed on tubular axle 29 by distance sleeves 44, 45 and nut 46. Cylindrical surfaces are made on the end faces of second cover 35 and flange 30 facing each other, on the second of which a metal ring 47 is put with interference fit, the ring enclosing the first cylindrical surface with a clearance and preventing the soil penetration between the end faces of cover 35 and flange 30 moving relative to each other. In addition, the clearances between cover 35, flange 30 and spacer ring 44 are sealed by a felt ring 48 and rubber cup 49. Such a design of the spiral mill is compact and provides small enough loads on bearings 31, 32. The fasteners of tubular axle 29 and case of reduction gear 40 can accommodate high loads, whereas the drive torsion shaft 33 ensures compensation of the relative displacements and skewing of the structural members resulting from both inaccuracies of fabrication and assembly, and deformations from working loads. In addition, torsion shaft 33 lowers dynamic loads on reduction gear 40 when spiral mill 8 comes against an insurmountable obstacle. Here, the design prevents the penetration of the soil particles onto the surfaces moving relative to each other.

Blades 27 on the outer surface of hollow shaft 26 are located along a helix with the left-hand direction for spiral mill 8 of left end effector 4 and right-hand winding direction for spiral mill 8 of right end effector 5. Here, due to the counter-clockwise direction of rotation of mills 8 in FIG. 1, soil throwing by blades 27 over breasts 10 is eliminated, no matter how high is the angular velocity of rotation of mills 8. Increase of the angular velocity of rotation of mills 8 in the claimed machine permits reduction of the force required for feeding the spiral mills to the face, due to decrease of the thickness of the strip being cut off, and improvement of the efficiency of soil removal from the frontal zone of breasts 10, thus lowering the resistance to displacement of the latter. The above permits reduction of the traction force required for the machine displacement along the pipeline. In addition, elimination of the soil throwing over breast 10 improves the quality of the machine operation due to the constant depth of digging and levelling of the trench bottom under the pipeline, which can be used for displacement of other machines, for instance those supporting the pipeline.

Reduction gear 40 has input shaft 50 which is located vertical and through propeller shaft 51 is connected to vertical shaft 52 of electric motor 53 which is located with a shift relative to input shaft 50 towards post 6, thus permitting the machine width clearance to be reduced. Electric motor 53 is fastened on bracket 54 which is mounted on the upper part of post 6.

Device 2 for machine displacement over the pipeline, incorporates idle wheels 55, 56 which provide the direction of the machine displacement along the curvilinear sections of the pipeline. It is fisher fitted with tubular levers 57 located on the pipeline sides and mounted on frame 1 with the capability of forced rotation and fixation around longitudinal axles 58, and telescopic supports 59. Inner tubular elements 60 of the latter, are mounted with the capability of forced displacement and fastening in outer tubular elements 61 which are fitted with tubular brackets 62 installed on lower arms 63 of levers 57 with the capability of forced displacement and fixation. Wheels 55 are made conical and mounted at the ends of inner elements by means of axles co-axial with the latter with their location under the pipeline in the vertical planes parallel to the pipeline longitudinal axis. For rotation and fixation of levers 57 the machine incorporates turn buckle 64 with steering wheel 65 hinged to the upper end of levers 66 whose lower ends are hinged to upper arms 67 of levers 57, whereas the middle parts are hinged to bridge 68. For displacement and fixation of elements 60 each telescopic support has screw mechanism 69 and pin 70. For displacement and fixation of bracket 62 each lever 57 has screw mechanism 71 and pin 72. Wheels 56 are made cylindrical and are located in the horizontal symmetry plane of the pipeline cross-section between posts 6 and levers. 57. Axles 73 of wheels 56 are fitted with plates 74 located normal to them, which are fastened by bolts to plates 75 of frame 1. Here, axles 73 are shifted relative to the geometrical center of plates 74, 75; therefore when plates 74 are mounted in different angular positions, the position of wheels 56 across the machine width changes in accordance with the change of the diameter of the pipeline being dug.

Caterpillar drive travelling unit 3 is made in the form of frame 1 located in opening 76 and mounted on it on cantilevers 77 extended frame 78 on which the caterpillar chain is installed on tension 79 and drive 80 sprockets. The latter can have different designs, for instance in the form of a regular caterpillar chain with rigid tracks hinged to each other (not shown in the drawing). It is, however, preferable for the caterpillar chain to be made in the form of two plate traction chains 81 located in vertical planes parallel to the pipeline longitudinal axis.

The links of traction chains 81 carry, in the planes normal to the pipeline longitudinal axis, rigid cross-pieces 82 with brackets 83 at their ends, which protrude beyond the contour of traction chains 81. Flexible supporting elements 84 have their ends connected to brackets 83. Tension 79 or drive 80 sprockets are mounted on the common tension 85 and drive 86 shafts, respectively, the latter of which is connected to the output shaft of the reduction gear of drive 87 which is fastened on frame 78.

Figure 2:
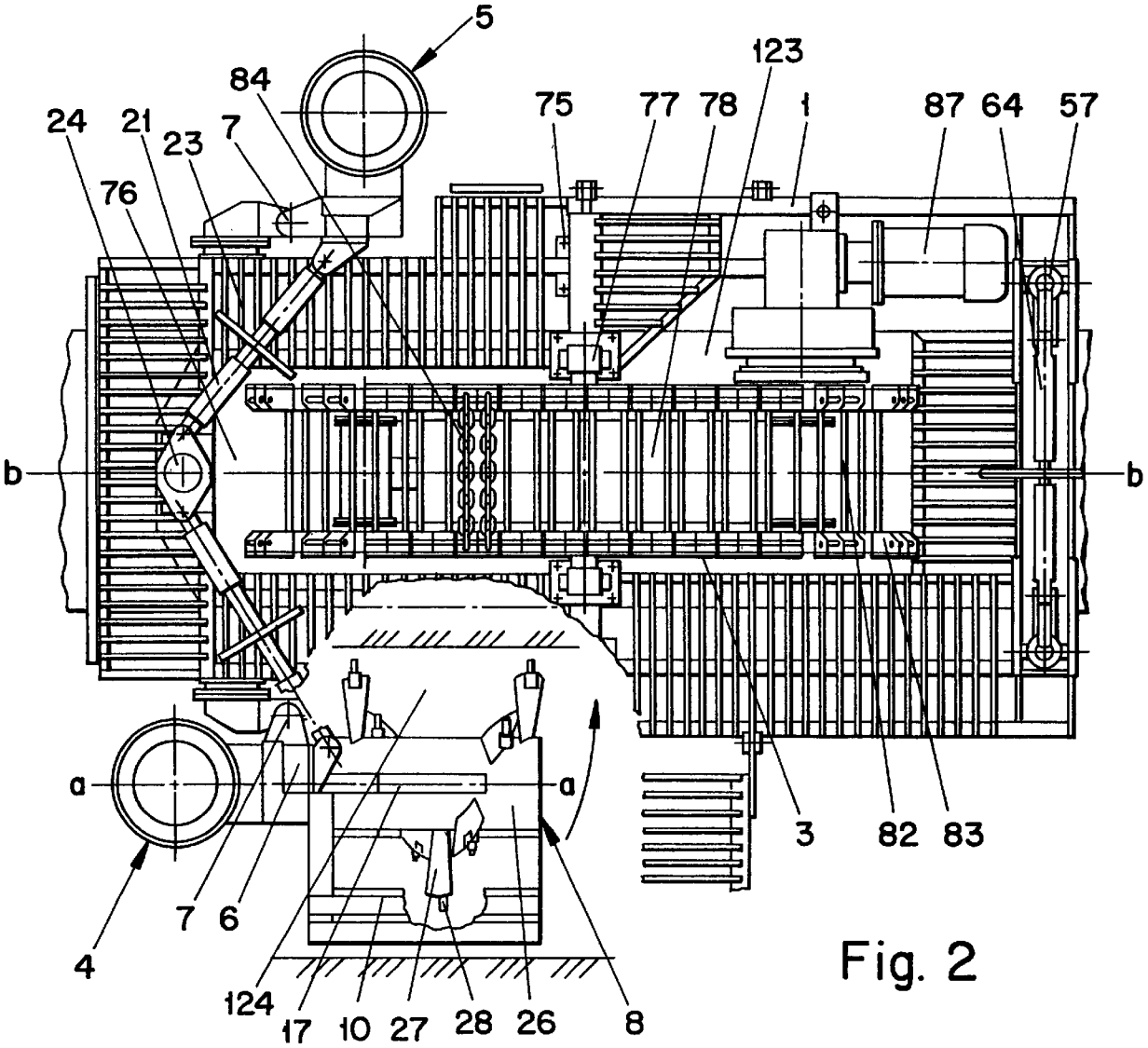
FIG. 2 is the same, top view.
Figure 7:
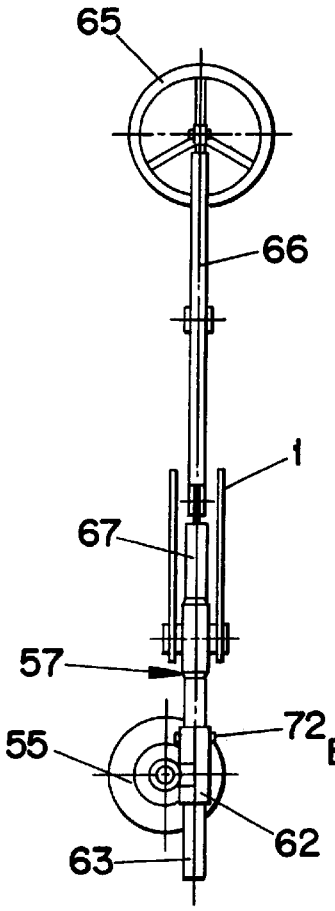
FIG. 7 is view D in FIG. 6.

Cross-pieces 82, brackets 83 and elements 84 can have different design embodiments. Here, the following embodiment is preferable. Flexible supporting elements 84 are made in the form of round-link chains whose end links 88 are located in the planes normal to the pipeline longitudinal axis and are connected by pins 89 with plates 90 of brackets 83, located in parallel to them, which are made to have bevels 91 from the side of the pipeline. In FIG. 2 round-link chains 84 are conditionally shown for only one pair of brackets 83, while in the actual equipment a pair of chains 84 has its ends connected to each pair of brackets located opposite each other. Rigid cross-pieces 82 are made in the form of axles with collars 92 and threaded ends for nuts 93, whose ends are rigidly mounted in co-axial holes made in plates 94 of traction chains 81 and located between them parts of brackets 83. Plates 90 of each bracket 83 are connected with each other by plate 95 normal to them, from the side opposite to bevels 91. In order to provide a one-sided inflexion of chains 3 the length of brackets 83 is equal to the pitch of traction chains 81, thus allowing reduction of the number of supporting rollers 96 or their complete elimination. Each pair of brackets 83 is coupled with two axles 82 and two round-link chains 84.

Round-link chains 84 are made to have such a length $L_1$ which is smaller than length L of theoretical contour of chain 84 which is produced in bending of the latter by the outer contour of the cross-section of the pipeline located with contacting the surfaces of plates 90 facing it or pins 89 with jamming of end links 88 or axles 82. In other words, round-link chains 84 should be short enough for their tension to be ensured when travelling unit 3 is mounted on the pipeline for transferring to it the support-traction loads through chains 84 due to their tension.

Length L for the design embodiment shown in FIG. 13 can be tentatively determined from the following equation:

$$L = \frac{\pi * (D_{\max} + h) * \arcsin\,[b/(D_{\max} + h)]}{180°}, \quad \text{where}$$

$D_{max}$ is the largest design diameter of the pipeline;

h is the height of the link of round-link chain 84;

b is the distance between the axes of pins 89;

L is the length of round-link chain 84 measured between the axes of pins 89.

The caterpillar chain of the travelling unit can also have other embodiments, for instance flexible supporting elements 84 can be made in the form of metallic or synthetic ropes, flexible metal plates, wires or rubber-fabric strips, etc. Accordingly, different embodiments of the flexible supporting elements can be matched by various embodiments of brackets 83 and cross-pieces 82 which in any case should have sufficient strength and rigidity for accommodating the forces of tension of flexible supporting elements 84.

One of the advantages of embodiment of flexible supporting elements 84 in the form of round-link chains is the simplicity and compactness of the assemblies of connection of their end links to brackets 83.

The machine center of mass is located below the bearing surface of travelling unit 3 (pipeline upper surface), this increasing the machine resistance to rotation around the pipeline axis. Further, breasts 10 have shoes 97 which alongside with cleaning the trench bottom under the pipeline, also prevent the machine rotation around the pipeline axis by resting against the soil.

In addition, in the presented in the drawings preferable embodiment, the machine is fitted with a device of transverse stabilization 98 for controlling the machine skewing in the transverse plane (normal to the machine longitudinal axis). The above device 98 (FIGS. 15, 16) includes two stabilizing mechanisms 99 made similar to each other, each of which incorporates a supporting element made in the form of a ski 100 for resting against the surface of the bottom 101 of the trench under the pipeline. Ski 100 is connected by first hinge 102 with the rear lower part of breast 10, and by second hinge 103 to the bearing element of a variable length, which is made in the form of a screw jack 104. Screw jack 104 includes case 105 which accommodates, mounted on bearings 106 shaft 107, the shaft lower part being made in the form of screw 108, and tubular rod 109 whose upper end carries nut 110 which encloses screw 108 and the lower end has fork 111 which through axle 112 is connected to lug 113 of ski 100 with the formation of the above second hinge 103. Tubular casing 114 which encloses rod 109 is mounted on shaft 107. Case 105 is connected by third hinge 115 to lugs 116 rigidly fastened to the rear upper part of breast 10. Third hinge 115 is formed by two half-axles 117 with flanges. Half-axles 117 are placed in through holes of lugs 116 and blind holes of case 105. Upper end of shaft 107 is connected to drive 119 through telescopic propeller shaft 118, the drive being made as a manual type drive in the example represented in the drawings. Drive 119 includes case 120 mounted on frame 1, in which shaft 121 is installed on bearings (not shown in the drawings), the shaft lower end being connected to the above propeller shaft 118, and the upper end being fitted with handle 122.

For an expert in the field it is obvious that drive 119 in other embodiments can be made electromechanical, hydraulic or pneumatic. In addition, the bearing element of a variable length can have another design, for instance, in the form of a hydraulic cylinder. Finally, the supporting element can be made not only in the form of ski 100, but, for instance, in the form of a wheel or roller. In addition, transverse stabilization device 98 is quite capable of fulfilling its function having just one stabilizing mechanism 99 with one supporting element—ski 100. In this case the machine center of mass should be shifted towards ski 100 in such a way that the machine skewing were only possible in one direction.

DESCRIPTION OF THE INVENTION APPLICATION

The claimed machine for digging under pipelines can be used as follows:

First pipeline 123 is uncovered from above and from the sides using appropriate complementary machines. Here, the depth of side trenches 124 is made to be larger than the depth of the trench bottom which will be formed after passage of the claimed machine with formation of side pits 125.

The claimed machine whose posts 6 are turned so that spiral mills 8 are parallel to the machine longitudinal axis, while lower arms of levers 57 are turned so that wheels 56 are brought apart for a distance larger than the pipeline diameter, is mounted on the pipeline by an additional hoisting mechanism. Here, the bearing surface of travelling unit 3 is resting on pipeline 123, whereas posts 6 with mills 8 and telescopic supports 59 with wheels 55 are positioned in trench 124 on the sides of pipeline 123. Switching on of electric motor 53 drives to rotation spiral mill 8, for instance, of left end effector 4 and the operator standing on working platform 23, using appropriate turn buckle 21 turns post 6 counter-clockwise around axle 7 in FIG. 2 to the extreme position in which the axis of rotation a—a (FIG. 2) of spiral mill 8 is normal to longitudinal axis b—b of the machine, which coincides with the longitudinal axis of pipeline 123. Here, spiral mill 8 together with breast 10 and cutter 17 work the soil under pipeline 123 and removes it into the pit. Turning around of the right end effector 5 and its digging under pipeline 123 are performed in a similar fashion. Two operators can simultaneously turn around both end effectors, carrying out their simultaneous digging under the pipeline. As a result of shifting of axles 7 of rotation of posts 6 relative to the axes a—a of rotation of mills 8, the ends of the latter in rotation of the posts, have such a trajectory that they come right up to each other in the working position.

After the operator has left working platform 23, drive 87 of travelling unit 3 is switched on to provide machine movement forward, here spiral mills 8 work the soil under pipeline 123 and remove it into pits 125 on both sides of the pipeline. As the end faces of mills 8 are immediately adjacent to each other, they work the soil over the entire cross-section of the face, without leaving a pillar of the soil in the central part for its working by breasts 10, thus providing a smaller resistance to machine displacement.

Figure 6:
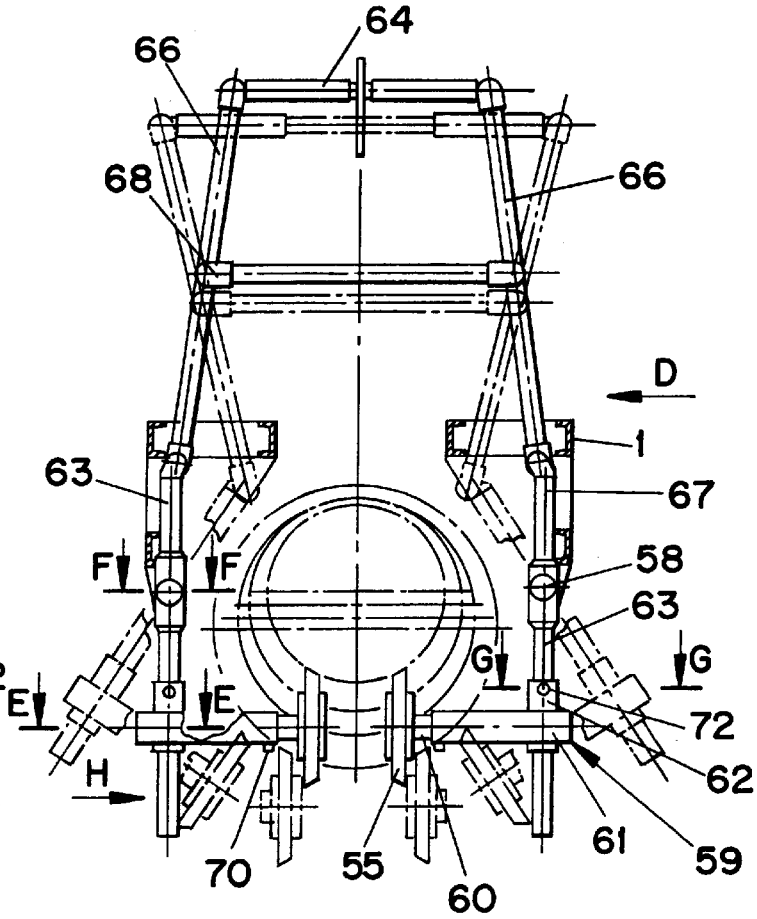
FIG. 6 is section C—C in FIG. 1.
Figure 9:
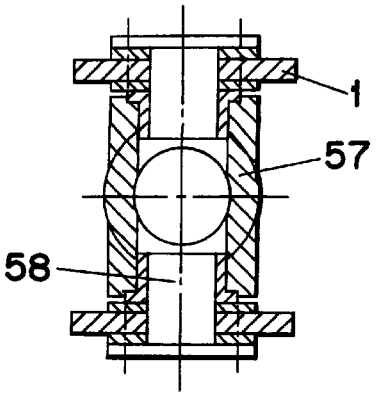
FIG. 9 is section F—F in FIG. 6.
Figure 10:
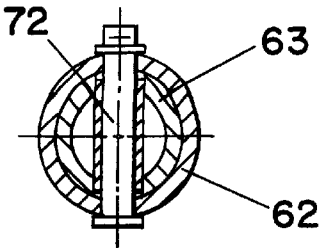
FIG. 10 is section G—G in FIG. 6.

After digging under pipeline 123 for a sufficient length, the machine stops and the operator having mounted to working platform 23, uses turn buckle 64 to turn levers 57 into the vertical position in which wheels 55 are located under pipeline 123 (FIG. 6), after which the machine is completely ready for operation. After the operator has left working platform 23, electric motors 53 of both end effectors 4, 5 and electric motor of drive 87 of travelling unit 3 are switched on, and the machine digs under pipeline 123

In the case if mills 8 come across an insurmountable obstacle (piece of rock, log, etc.), they are moved out from under pipeline 123 by rotation of posts 6, and wheels 55 by rotation of levers 57, then the machine moves forward beyond the obstacle location, after which mills 8 are again brought into the working position, digging under pipeline 123. Here, due to rotation of mills 8 with breasts 10 in the horizontal plane, the trench bottom 101 is not distorted. After digging under pipeline 123 for a sufficient length, levers 57 are rotated into the vertical position. For machine readjustment from digging under a pipeline of, for instance, larger diameter for digging under a pipeline of a smaller diameter, brackets 14 are fastened to plates 11 in a higher position to accommodate the difference in diameters, while cutters 17 of a larger diameter are changed for other replaceable cutters of a smaller diameter. Brackets 62 by means of screw mechanisms 71 are moved upwards on levers 57 and fixed by fingers 72. Inner elements 60 of supports 59 by means of screws 69 are moved out from outer elements 61 and fixed by pins 70. Plates 76 are turned around in the direction of shifting of axles 75 with wheels 56 inside frame 1 and are bolted to plates 77.

When the machine is used on cohesive clay soils, cutters 17 separate from the pipeline lower surface the soil layer adhering to it, which falls off on mills 8 and is removed from under the pipeline. The soil is additionally loosened by upper 18 and lower 19 horizontal cutters, here, embodiment of the bracket for attachment of cutter 17 in the form of cutters 18, 19 provides the least resistance to the machine displacement. In the case if breasts 10 had non-cylindrical parts protruding above rotors 8 instead of cutters 17, 18, 19, the resistance to machine displacement would be higher.

Caterpillar drive travelling unit 3 can be mounted without any adjustments on pipelines of various diameters, which are equal to or smaller than the greatest design diameter $D_{max}$. In this case, tension of round-link chains 84 which bend around the pipeline and are in close contact with its outer surface, is provided (FIGS. 13, 14). The pipelines being repaired have a layer of old insulation and a layer of soil stuck to it, a considerable part of pipelines being currently repaired having bitumen insulation of a relatively large thickness. Chains 84 have good engagement with the layer of old insulation both in the direction along the pipeline, and across it. Due to that, the coefficient of engagement of travelling unit 3 in movement over pipelines with insulation, is much higher than the coefficient of friction of steel on steel.

Figure 15:
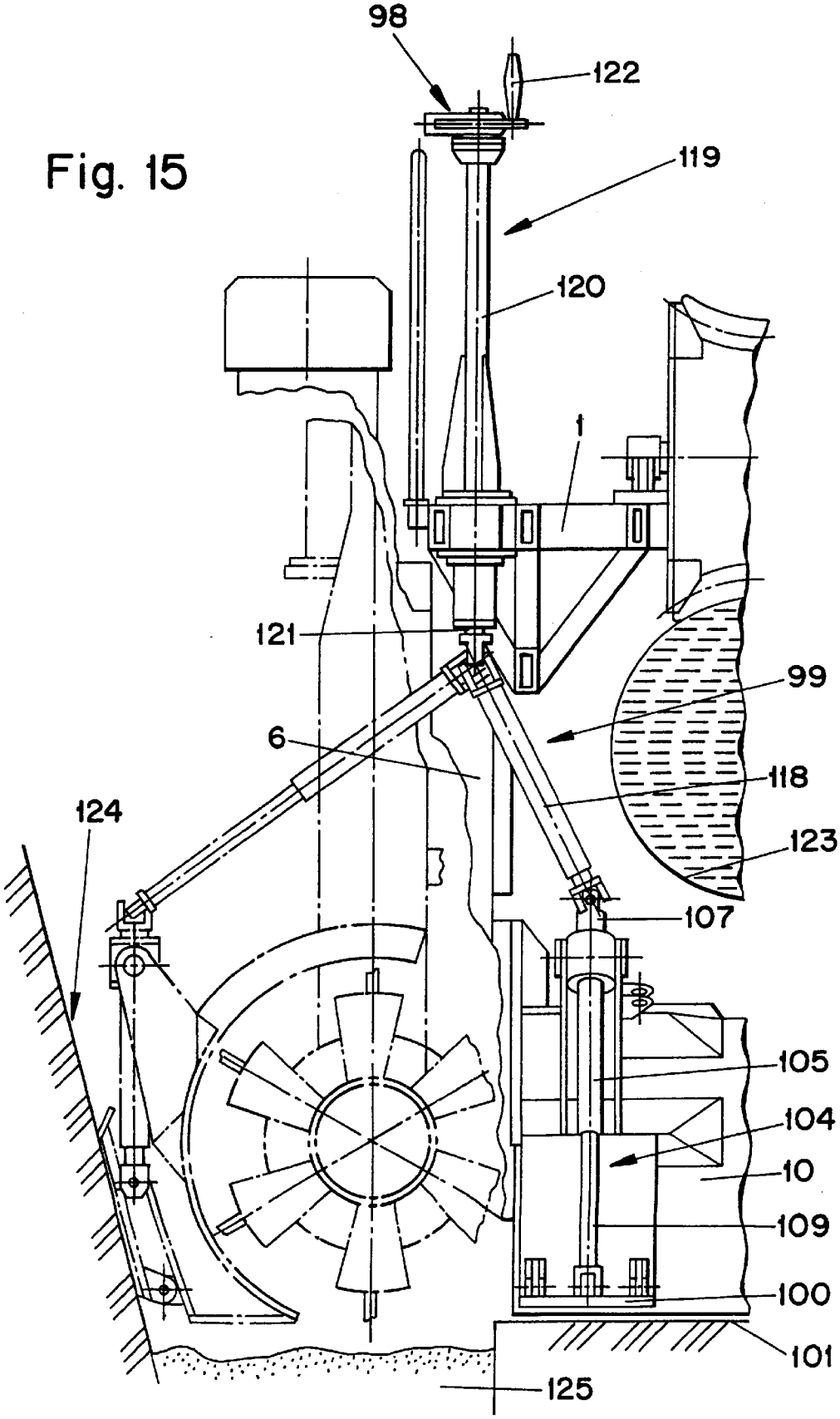
FIG. 15 is the device for transverse stabilisation of the machine, rear view.
Figure 16:
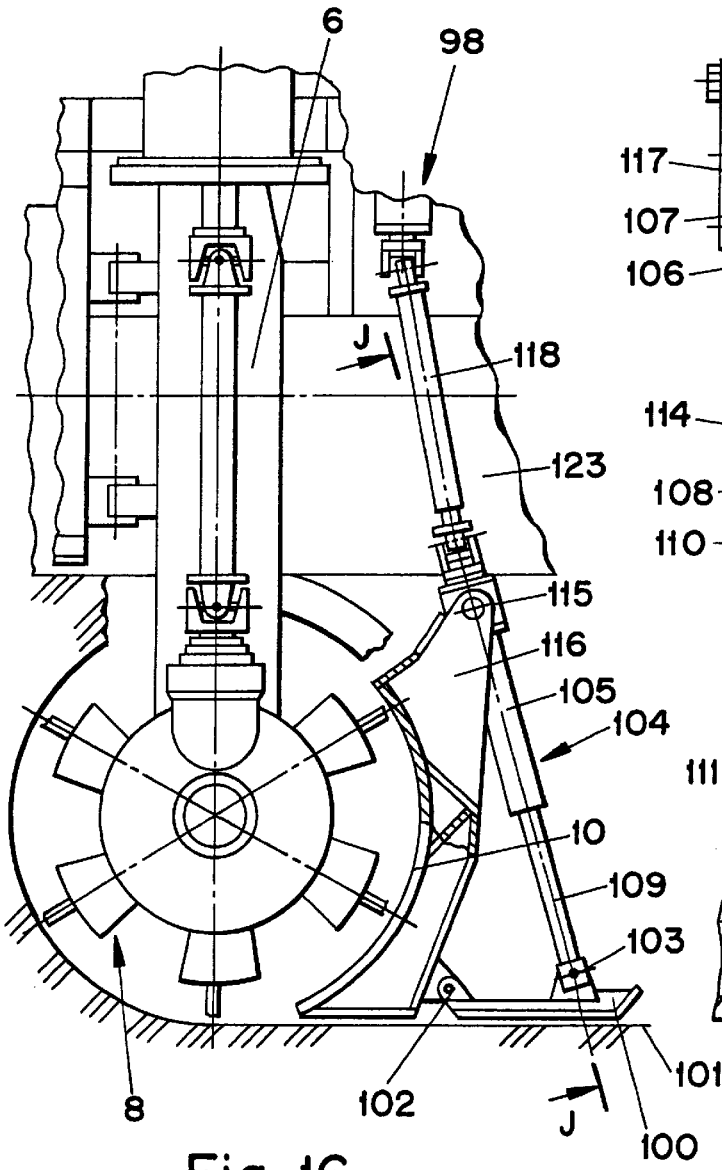
FIG. 16 is the same, left view (in the direction of the machine displacement)
Figure 17:
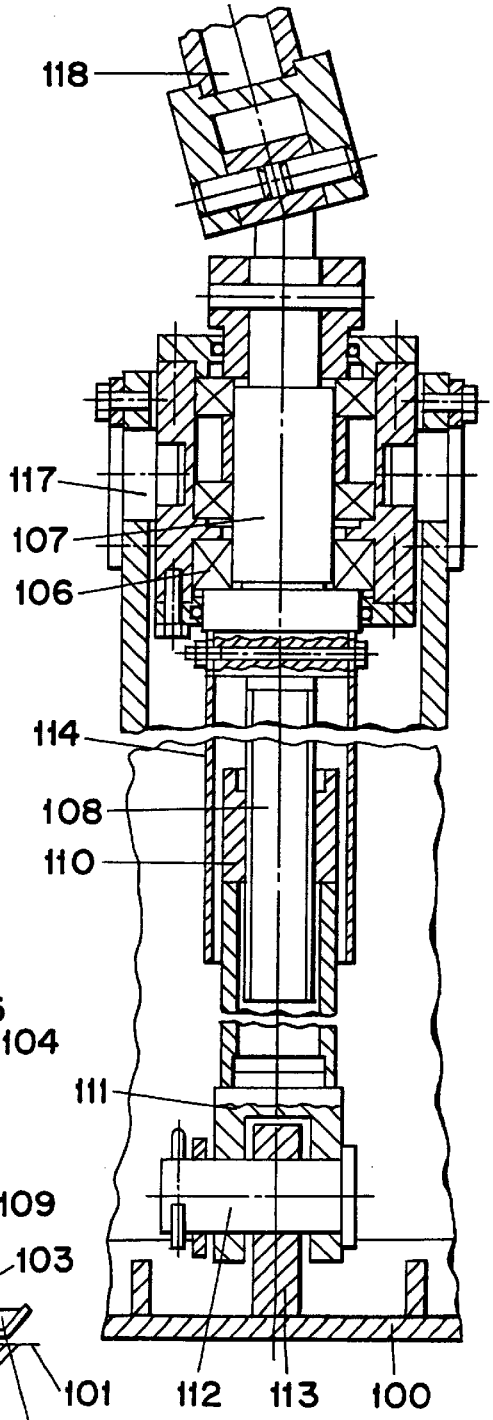
FIG. 17 is section J—J (FIG. 15).

If, for some reasons, for instance, as a result of the difference in the mechanical properties of the soil, machine skewing in the transverse plane has occurred, for instance, to the side of the left ski 100 (FIG. 16), the operator, by turning handle 122, somewhat lowers left ski 100 and, accordingly, somewhat raises right ski 100 (not shown conditionally in the drawings in FIGS. 15, 16). The machine levelling is a result of the force action on left ski 100 produced by the soil of the bottom 101 of trench 124.

Prior to moving spiral mills 8 from under pipeline 123, by turning handles 122 skis 100 are rotated into the extreme upper position, as is shown by dash-dotted lines in FIG. 16. Due to that, when spiral mills are mounted to the side of pipeline 123 in parallel to its longitudinal axis, skis 100 fall within clearance limits of trench 124 and do not prevent the rotation of posts 6, machine displacement along the pipeline or machine mounting on or taking off the pipeline.

In the case drive 119 is made electromechanical, hydraulic, pneumatic or the bearing element of a variable length is made in the form of a hydraulic cylinder, the transverse stabilization (leveling) of the machine can be carried out in the automatic mode, for which purpose the machine can be fitted with a system of automatic control.

What is claimed is:

1. A machine for digging under pipelines, comprising:

a frame;

a drive traveling unit mounted on the frame for machine movement over the pipeline;

at least one end effector incorporating a post mounted on the frame with the capability of forced rotation around a vertical axle;

a driven part for working soil under the pipeline, the driven part being mounted on a lower part of post and located to the side of the post; and a breast located behind the driven part in the direction of the machine movement the driven part of the end effector being a spiral mill, and the breast being fastened to the post while its working surface which faces the spiral mill concave, wherein spiral mill and working surface of breast are made cylindrical on the axis of rotation of spiral mill is located horizontal and co-axial with the axis of the working surface of breast.

2. A machine for digging under pipelines, comprising:

a frame;

a drive traveling unit mounted on the frame for machine movement over the pipeline;

at least one end effector incorporating a post mounted on the frame with a capability of forced rotation around a vertical axle;

a driven part for working soil under the pipeline, the driven part being mounted on a lower part of post and located to the side of the post; and a breast located behind the driven part in the direction of the machine movement, the driven part of the end effector being a spiral mill, and the breast being fastened to the post while its working surface which faces the spiral mill is concave, wherein end effector is fitted with cutter which is made in the form of a segment of a ring, is located in front of breast and fastened to post.

3. A machine for digging under pipelines, comprising:

a frame;

a drive traveling unit mounted on the frame for machine movement over the pipeline;

at least one end effector incorporating a post mounted on the frame with a capability of forced rotation around a vertical axle;

a driven part for working soil under the pipeline, the driven part being mounted on a lower part of post and located to the side of the post; and a breast located behind the driven part in the direction of the machine movement, the driven part of the end effector being a spiral mill, and the breast being fastened to the post while its working surface which faces the spiral mill is concave, wherein post of end effector is mounted on frame with the capability of placement into at least two height positions.

4. A machine for digging under pipelines, comprising:

a frame;

a drive traveling unit mounted on the frame for machine movement over the pipeline;

at least one end effector incorporating a post mounted on the frame with a capability of forced rotation around a vertical axle;

a driven part for working soil under the pipeline, the driven part being mounted on a lower part of post and located to the side of the post; and a breast located behind the driven part in the direction of the machine movement, the driven part of the end effector being a spiral mill, and the breast being fastened to the post while its working surface which faces the spiral mill is concave, wherein it incorporates two end effectors made as the mirror reflection of each other and located symmetrical relative to a machine longitudinal axis.

5. The machine according to claim 4, wherein the above vertical axles of rotation of posts relative to the axes of rotation of spiral nulls are shifted in opposition to breasts.

6. The machine according to claim 4, wherein the spiral mills have lefthand direction of blade turn for the left spiral mill in the direction of the machine movement and right-hand direction for the right spiral mill.

7. A machine for digging under pipelines, comprising:

a frame;

a drive traveling unit mounted on the frame for machine movement over the pipeline;

at least one end effector incorporating a post mounted on the frame with a capability of forced rotation around a vertical axle;

a driven part for working soil under the pipeline, the driven part being mounted on a lower part of post and located to the side of the post; and a breast located behind the driven part in the direction of the machine movement, the driven part of the end effector being a spiral mill, and the breast being fastened to the post while its working surface which faces the spiral mill is concave, wherein drive traveling unit is a caterpillar unit.

8. The machine according to claim 7 wherein it is fitted with idle wheels, levers mounted on a rear part of frame with a capability of forced rotation and fixation, and telescopic supports whose inner elements are installed with a capability of forced displacement and fixation in outer elements which are fitted with brackets mounted on levers with a capability of forced displacement and fixation; the first of the idle wheels are conical and are fastened at ends of inner elements of telescopic supports with their positioning under the pipeline in the vertical planes parallel to the pipeline longitudinal axis, whereas a second of the idle wheels are located in the horizontal plane, while their axles are mounted on lower horizontal plates of frame with a capability of their movement at least into two positions across the machine width.

9. A machine according to claim 7, further comprising a device for transverse stabilization.

10. The machine according to claim 9, wherein device for transverse stabilization of the machine incorporates at least one stabilizing mechanism including supporting element for resting on a trench bottom, which is mounted on the rear part of breast with a capability of forced rotation or linear displacement in the vertical direction.

11. The machine according to claim 10, wherein the supporting element is made in the form of a ski which by a first hinge is connected to the breast, and by a second hinge it is connected to a bearing element of a variable length which is connected to the breast by a third hinge.

12. The machine according to claim 11 wherein the bearing element of a variable length is a screw jack which by means of telescopic propeller shaft is connected to drive which is mounted on the frame of the machine.

13. The machine according to claim 12, wherein the drive is a manual type drive.

14. The machine according to claim 10, wherein device for transverse stabilization of the machine includes two stabilizing mechanisms made similar to each other and spaced in the traverse direction.

15. Caterpillar traveling unit predominantly for displacement over pipelines, incorporating frame and caterpillar chain mounted on frame by means of tension and drive sprockets and including rigid elements protruding beyond an outer surface of the caterpillar chain, as well as flexible supporting elements connected to rigid elements, wherein flexible supporting elements are connected with the rigid elements without linear displacements and are short enough to enable their tension by a contour of the cross-section of the pipeline or cross-section of a convex-curvilinear shape of any other extended body, the caterpillar chain is made sufficiently rigid in a transverse direction for accommodating forces of tension of the flexible supporting elements.

16. The device claimed in claim 15, wherein the caterpillar chain is two plate traction chains mounted on the drive and tension sprockets and rigid cross-pieces located in the planes normal to a device longitudinal axis and fastened to inner and outer plates of traction chains, here the rigid elements are brackets rigidly coupled with the ends of rigid cross-pieces.

17. The caterpillar traveling unit claimed in claim 16, wherein flexible supporting elements are chains whose end links are located in planes normal to the device longitudinal axis and are connected by pins to located in parallel to them plates of brackets, which from a pipeline side are made to have bevels, whereas rigid cross-pieces are axles whose ends are rigidly mounted in co-axial holes made in plates of traction chains and located between them parts of brackets whose length is equal to a pitch of the traction chains.

18. A machine for digging under pipelines, comprising:

a frame;

a self-propelled unit mounted on the frame and adapted for machine movement along the pipeline;

a first end effector which includes a post mounted on the frame with a capability of rotation about a vertical axle;

a driven spiral mill for working soil under the pipeline, the driven spiral mill being mounted on a lower part of the post so as to move between an active working position by rotation in which an axis of rotation of the spiral mill is located essentially normal to a longitudinal axis of the pipeline and an inactive idle position in which the axis of rotation of the spiral mill is essentially parallel to the longitudinal axis of the pipeline;

the first end effector including a breast which has a working surface facing the spiral mill and being concave, the breast being mounted on the lower part of the post so as to move together with the spiral mill between an active position in which the breast is located behind the spiral mill in a direction of the machine movement and an inactive position; and a second end effects which is made similar to the first end effector wherein, in the active position, end faces of the spiral mill and the breast of the first end effector removed from the post are in close proximity to end faces of the spiral mill and the breast of the second end effector.

19. The machine claimed in claim 18, wherein vertical axes of rotation of the posts relative to axes of rotation of the spiral mills are shifted in opposition to the breast so that in the active position, the end faces of the spiral mill and the breast of the first end effector, removed from the post, are brought in close proximity to the end faces of the spiral mill and the breast of the second end effector solely by means of rotation about the vertical axles.

20. The machine as claimed in claim 18, wherein the spiral mill and working surface of the breast are cylindrical, the axes of rotation of the spiral mill being located horizontal and co-axial with axes of the working surface of the breast.

21. The machine as claimed in claim 18, wherein the end effectors are fitted with cutters, each of the cutters being a segment of a ring, the cutters being located in front of the breasts and being fastened to the posts.

22. The machine as claimed in claim 18, wherein the posts of said first and second end effectors are mounted on the frame of the machine with a capability of displacement into at least two height positions.

23. The machine as claimed in claim 18, wherein the spiral mills are made with a left-hand direction of blade turn for the left spiral mill in the direction of the machine movement and right-hand direction of blade turn for the right spiral mill.

24. The machine as claimed in claim 18, wherein the self-propelled unit is adapted for displacement along an outer surface of the pipeline so that essentially the machine is supported and guided by the pipeline and when the active position, the spiral mills and the breasts are located essentially under the frame of the machine, the posts being mounted essentially directly on the frame of the machine.

25. The machine as claimed in claim 24, further comprising two supporting elements which are adapted for resting on a trench bottom surface formed by the breast, the supporting elements being mounted on rear parts of the breast of the first and second end effectors with a capability of forced rotation or linear displacement in a vertical direction so as to prevent spontaneous rotation of the machine about the longitudinal axes of the pipeline and provide correct orientation of the machine.

26. The machine as claimed in claim 25, wherein the supporting elements are a ski wherein a first hinge is connected to the breast, and by a second hinge the supporting elements are connected to a bearing element of a variable length which is connected to the breast by a third hinge.

27. The machine as claimed in claim 26, wherein the bearing element of a variable length is a screw jack which by means of telescopic cardan shaft is connected to a drive mounted on the frame of the machine.

28. The machine as claimed in claim 27, wherein the drive is a manual type drive.

29. The machine as claimed in claim 24, wherein the self-propelled unit includes idle wheels, levers mounted on a rear part of the frame of the machine with a capability of forced rotation and fixation, and telescopic support which have outer elements and inner elements which are installed with a capability of forced displacement and locking in the outer elements, the outer elements being fitted with brackets mounted on the levers with a capability of forced displacement and fixation, a first of the idle wheels is conical and is fastened at ends of the inner elements of the telescopic supports and is located under the pipeline with a capability of rotation in vertical planes parallel to pipeline longitudinal axis, whereas a second idle wheel is located with a capability of rotation in the horizontal plane, and includes axles which are mounted on lower horizontal planes of the frame with a capability of placing axles at least into two positions across a machine width.

30. The machine as claimed in claim 24, wherein the self-propelled unit includes a caterpillar drive travelling unit having a frame which is mounted on the frame of the machine, a caterpillar chain mounted on the frame of the travelling unit by means of tension and drive sprockets, whereas the caterpillar chain includes rigid elements protruding beyond an outer surface of a middle part of the caterpillar chain and arranged in two rows which are spaced across the caterpillar chain, flexible supporting elements being connected to the rigid elements without an ability of linear displacement and are short enough to enable their tension by a contour of the cross-section of the pipeline, the caterpillar chain being made sufficiently rigid in a transverse direction for accommodating the forces of tension of the flexible supporting elements.

31. A caterpillar travelling unit predominately for displacement over a pipeline, comprising:

a frame;

a caterpillar chain mounted on the frame by means of tension and drive sprockets;

rigid elements protruding beyond an outer surface of a middle part of a caterpillar chain and arranged in two rows which are spaced across the caterpillar chain;

flexible supporting elements being connected to the rigid elements without an ability of linear displacements and being short enough to enable their tension by a contour of the cross-section of the pipeline or cross-section of a convex-curvilinear shape of another extended body, the caterpillar chain being made sufficiently rigid in a transverse direction for accommodating the forces of tension of the flexible supporting elements.

32. The device as claimed in claim 31, wherein the caterpillar chain is two plate traction chains mounted on the drive and tension sprocket, rigid cross-pieces being located in planes normal to a longitudinal axes of the device and fastened to the inner and outer plates of traction chains, the rigid elements being brackets rigidly coupled with ends of the rigid cross-pieces.

33. The unit as claimed in claim 32, wherein the flexible supporting elements are made in the form of chains whose end lengths are located in the planes normal to the longitudinal axis of the unit, and are connected by pins, which from the pipeline side are made to have bevels, whereas rigid cross-pieces are axles whose ends are rigidly mounted in co-axial holes made in plates of traction chains and located between them parts of brackets whose length is equal to a pitch of the traction chains.

34. A machine for digging under pipelines, comprising:

a frame;

a self-propelled unit mounted on the frame and adapted for machine movement along a pipeline;

an end effector which includes a post mounted on the frame with a capability of rotation about a vertical axis;

a driven spiral mill for working soil under the pipeline, the driven spiral mill being mounted on a lower part of the post so as to move between an active working position by rotation in which an axis of rotation of the spiral mill is located essentially normal to a longitudinal axis of the pipeline and an inactive idle position in which the axis of rotation of the spiral mill is essentially parallel to the longitudinal axis of the pipeline;

the end effector including a breast which has a working surface which faces the spiral mill and is concave, the breast being mounted on the lower part of the post so as to take together with the spiral mill an active position in which the breast is located behind the spiral mill in a direction of the machine movement and an inactive position, the self-propelled unit being adapted for displacement along an outer surface of the pipeline so that the machine is essentially supported and guided by the pipeline, in the active position, the spiral mill and the breast are located essentially under the machine frame, the post being mounted essentially directly on the frame; and at least one supporting element which is adapted for resting on a trench bottom surface formed by the breast, the supporting element being mounted on a rear part of the breast with a capability of forced rotation or linear displacement in a vertical direction so as to prevent spontaneous rotation of the machine along the longitudinal axis of the pipeline and provide a correct orientation of the machine.

35. The machine as claimed in claim 34, wherein the supporting element is a ski which by a first hinge is connected to the breast, and by a second hinge is connected to a bearing element of a variable length, which is connected to the breast by a third hinge.

36. The machine as claimed in claim 35, wherein the bearing element of a variable length is a screw jack which by means of telescopic cardan shaft is connected to a drive mounted on the frame.

37. The machine as claimed in claim 36, wherein the drive is a manual type drive.

38. The machine as claimed in claim 34, further comprising:

two supporting elements similar to each other and located at a predetermined distance in a direction along the breast.

39. The machine according to claim 34, wherein the self-propelled unit includes a caterpillar drive traveling unit, the traveling unit including a frame which is mounted on the frame of the machine; the caterpillar chain being mounted on the frame of a traveling unit by means of tension and drive sprockets, wherein the caterpillar chains includes rigid elements protruding beyond an outer surface of the middle part of a caterpillar chain and arranged in two rows which are spaced across the caterpillar chain, the flexible support elements being connected to the rigid elements without linear displacements and are short enough to enable their tension by a contour of the cross-section of the pipeline, the caterpillar chain being made sufficiently rigid in the transverse direction for accommodating forces of tension of the flexible support elements.

* * * * *